US006785920B1

(12) United States Patent
Amador, Jr.

(10) Patent No.: US 6,785,920 B1
(45) Date of Patent: Sep. 7, 2004

(54) BED FRAME SYSTEM

(76) Inventor: Cesar F. Amador, Jr., 1344 Park Rd. NW., Washington, DC (US) 20010

( * ) Notice: Subject to any disclaimer, the term of this patent is extended or adjusted under 35 U.S.C. 154(b) by 0 days.

(21) Appl. No.: 10/441,316

(22) Filed: May 19, 2003

(51) Int. Cl.[7] ..... A47C 19/00
(52) U.S. Cl. ..... 5/308; 5/400
(58) Field of Search ..... 5/400, 308, 201, 5/202

(56) References Cited

U.S. PATENT DOCUMENTS 936,969 A 10/1909 Williams
4,259,755 A 4/1981 Hollander
4,597,122 A 7/1986 Handler et al.
D360,299 S 7/1995 Macek

*Primary Examiner*—Teri Pham Luu

(57) ABSTRACT

A bed frame system for providing storage under a mattress. The bed frame system includes a plurality of storage assemblies being designed for being positioned under the mattress to support the mattress. Each of the storage assemblies comprises a perimeter wall defining an interior space of the associated one of the storage assemblies whereby the interior space of each of the storage assemblies is designed for receiving items to be stored under the mattress. The storage assemblies are selectively coupled together. Each of the storage assemblies comprises a plurality of casters being coupled to the perimeter wall. Each of the casters is designed for being positioned between the perimeter wall of the associated one of the storage assemblies and a support surface for facilitating moving of the storage assemblies across the support surface.

20 Claims, 4 Drawing Sheets

BED FRAME SYSTEM

BACKGROUND OF THE INVENTION

1. Field of the Invention

The present invention relates to under bed storage devices and more particularly pertains to a new bed frame system for providing storage under a mattress.

2. Description of the Prior Art

The use of under bed storage devices is known in the prior art. U.S. Pat. No. 4,259,755 describes a system for forming furniture and providing storage in the furniture Another type of under bed storage device is U.S. Pat. No. 936,969 having a wardrobe that is coupled to a bed frame so that the wardrobe is positioned below the mattress. U.S. Pat. No. 4,597,122 has a free-standing drawer that can be selectively positioned under a bed frame. U.S. Pat. No. Des. 360,299 shows an under bed storage trolley.

While these devices fulfill their respective, particular objectives and requirements, the need remains for a system that has certain improved features that allows the drawers to be coupled together to for a frame for a mattress.

SUMMARY OF THE INVENTION

The present invention meets the needs presented above by providing mounting apertures in each of the storage assemblies that allow the storage assemblies to be coupled together to form a frame for the mattress.

Still yet another object of the present invention is to provide a new bed frame system that provides a plurality of storage aids for facilitating storing of items in the storage assemblies Even still another object of the present invention is to provide a new bed frame system that provides casters on each of the storage assemblies to allow the storage assemblies and mattress to be moved.

To this end, the present invention generally comprises a plurality of storage assemblies being designed for being positioned under the mattress to support the mattress and the user when the user is positioned on the mattress. Each of the storage assemblies comprises a perimeter wall defining an interior space of the associated one of the storage assemblies whereby the interior space of each of the storage assemblies is designed for receiving items to be stored under the mattress. The storage assemblies are selectively coupled together whereby the storage assemblies are movable together to facilitate repositioning of the mattress. Each of the storage assemblies comprises a plurality of casters being coupled to the perimeter wall. Each of the casters is designed for being positioned between the perimeter wall of the associated one of the storage assemblies and a support surface for facilitating moving of the storage assemblies across the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
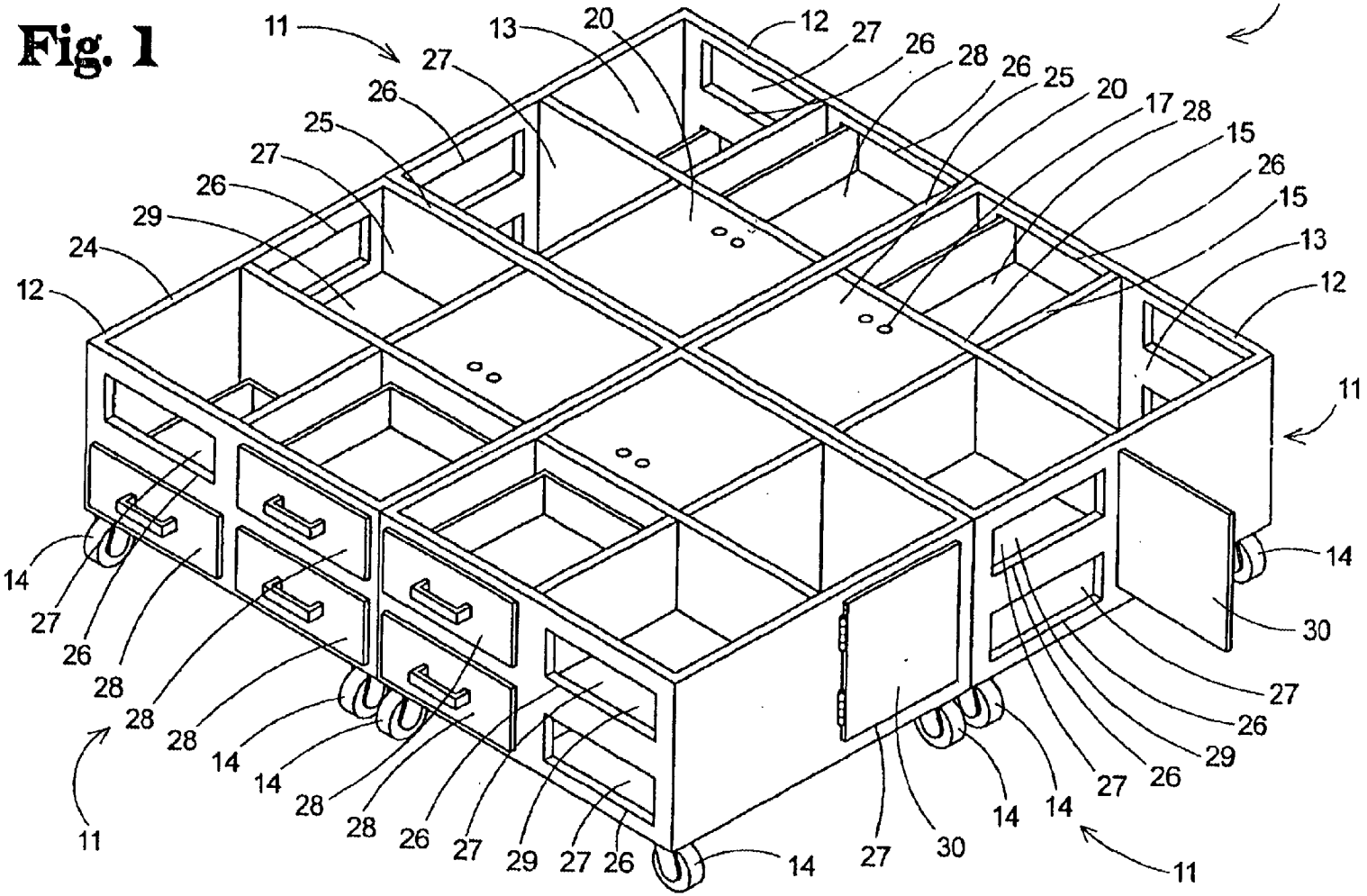
FIG. 1 is a perspective view of a new bed frame system according to the present invention shown in use.
Figure 2:
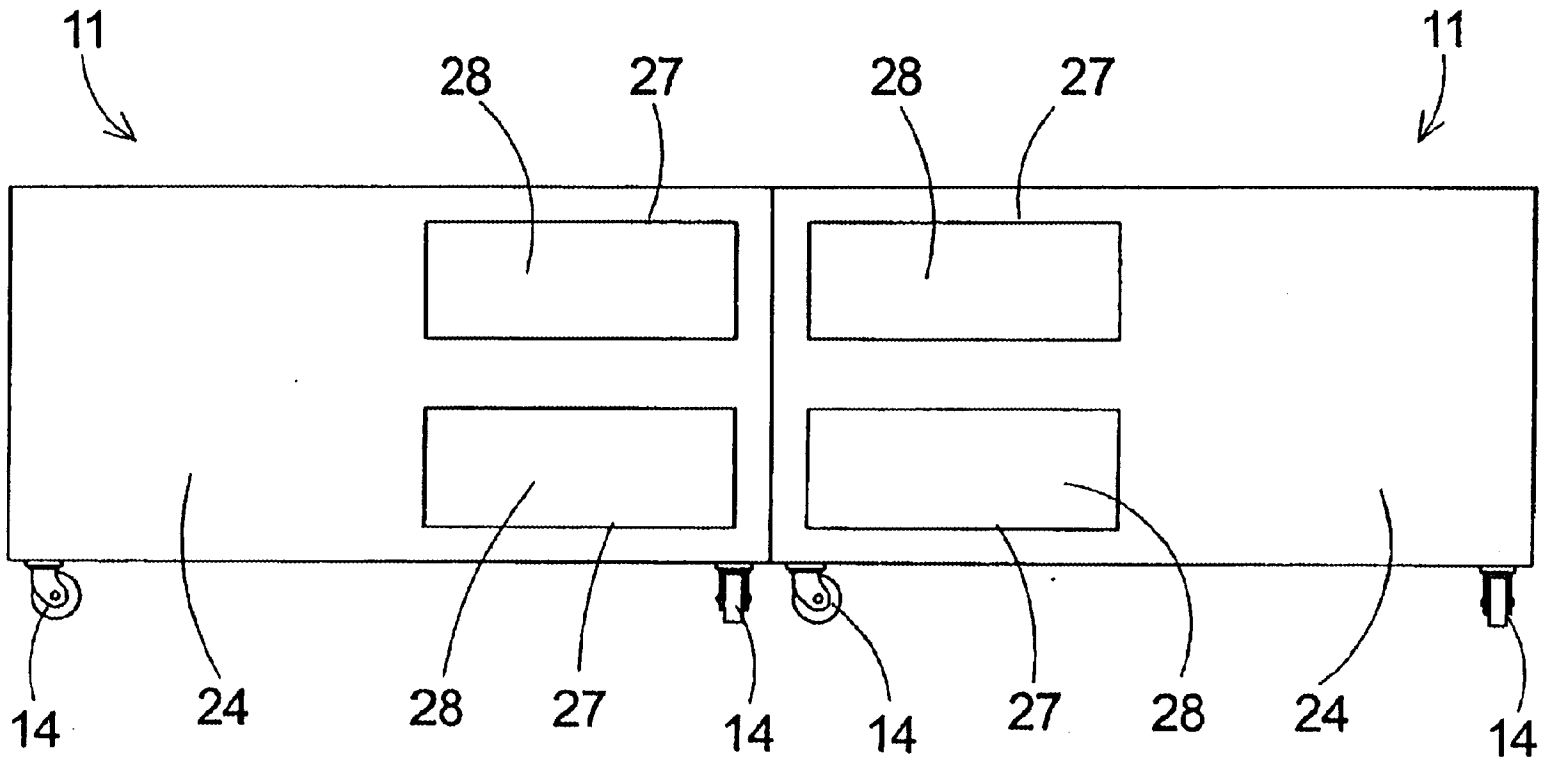
FIG. 2 is a front view of the present invention.
Figure 3:
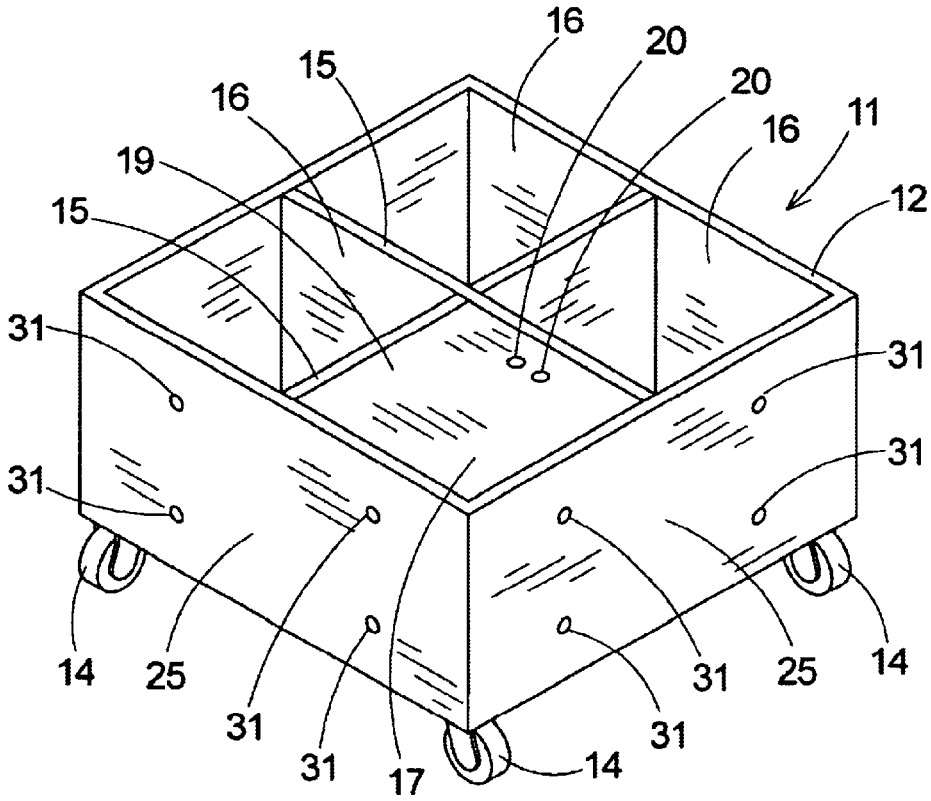
FIG. 3 is an enlarged perspective view of one of the storage assemblies of the present invention.
Figure 4:
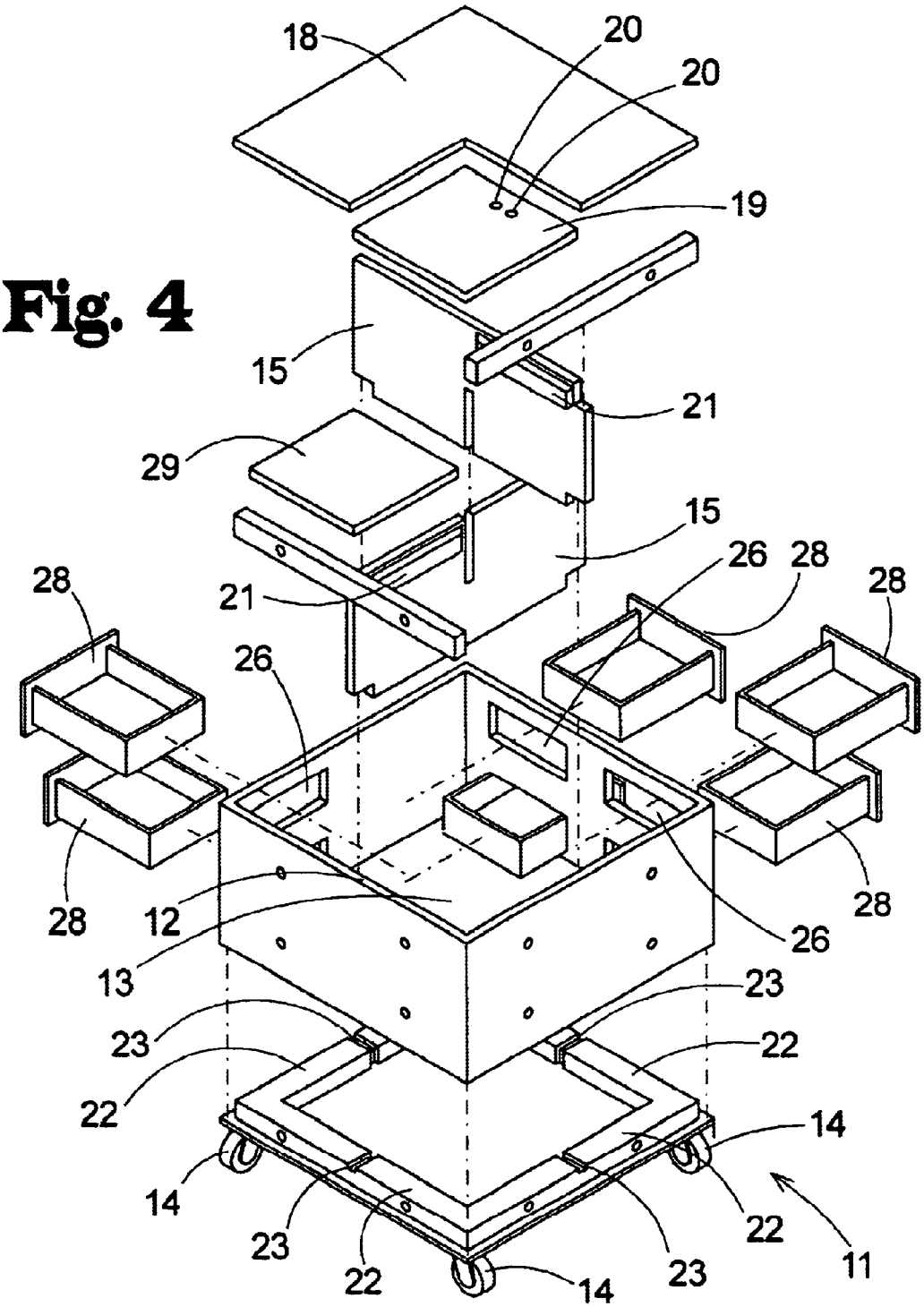
FIG. 4 is an exploded perspective view of one of the storage assemblies of the present invention.

With reference now to the drawings, and in particular to FIGS. 1 through 4 thereof, a new bed frame system embodying the principles and concepts of the present invention and generally designated by the reference numeral 10 be described.

As best illustrated in FIGS. 1 through 4, the bed frame system 10 generally comprises a plurality of storage assemblies 11 being designed for being positioned under the mattress to support the mattress and the user when the user is positioned on the mattress. Each of the storage assemblies 11 comprises a perimeter wall 12 defining an interior space 13 of the associated one of the storage assemblies 11 whereby the interior space 13 of each of the storage assemblies 11 is designed for receiving items to be stored under the mattress. The storage assemblies 11 are selectively coupled together whereby the storage assemblies 11 are movable together to facilitate repositioning of the mattress. Each of the storage assemblies 11 comprises a plurality of casters 14 being coupled to a bottom wall of the perimeter wall 12. Each of the casters 14 is designed for being positioned between the perimeter wall 12 of the associated one of the storage assemblies 11 and a support surface for facilitating moving of the storage assemblies 11 across the support surface. Each of the storage assemblies 11 has a length of 41 inches, a width of about 39 inches and a height of about 26 inches for a king size mattress.

Each of the storage assemblies 11 comprises a plurality of partition walls 15. The partition walls 15 are coupled to the perimeter wall 12 whereby the partition walls 15 are positioned in the interior space 13 of the associated one of the storage assemblies 11. Each of the partition walls 15 is designed for providing additional support to the mattress when the mattress is positioned on the storage assemblies 11.

The partition walls 15 of each of the storage assemblies 11 divides the interior space 13 of the associated one of the storage assemblies 11 into a plurality of external compartments 16 and an internal compartment 17. The external compartments 16 of the storage assemblies 11 are designed for being positioned under a perimeter of the mattress whereby the external compartments 16 are designed for being accessed by the user to store items when the mattress is positioned on the storage assemblies 11. The internal compartment 17 of each of the storage assemblies 11 is designed for being positioned proximate the center of the mattress when the mattress is positioned on the storage assemblies 11 whereby the internal compartment 17 of the storage assemblies 11 is accessible when the mattress is removed from the storage assemblies 11.

Each of the storage assemblies 11 comprises a fixed platform member 18. The fixed platform member 18 is coupled to the perimeter wall 12 and the partition walls 15 of the associated one of the storage assemblies 11 whereby the fixed platform member 18 is positioned over the external compartments 16 of the associated one of the storage assemblies 11. The fixed platform of each of the storage assemblies 11 is designed for supporting the mattress and inhibiting the mattress from extending into the external compartments 16 of the associated one of the storage assemblies 11 when the mattress is positioned on the storage assemblies 11.

Each of the storage assemblies 11 comprises a cover member 19. The cover member 19 is selectively positioned on the perimeter wall 12 and the partitions walls of the associated one of the storage assemblies 11 whereby the cover member 19 is selectively positioned over the internal compartment 17 of the associated one of the storage assemblies 11. The cover member 19 is designed for being removed by the user to permitting access to the internal compartment 17 of the associated one of the storage assemblies 11 when the mattress is removed from the storage assemblies 11.

The cover member 19 of each of the storage assemblies 11 comprises at least one finger aperture 20 extending through the cover member 19. The finger aperture 20 of the cover member 19 is designed for receiving a finger of the user to allow the user to engage the cover member 19 to facilitate removal of the cover member 19 from the associated one of the storage assemblies 11.

Each of the storage assemblies 11 comprises a plurality of support members 21. Each of the support members 21 is coupled to the partition walls 15 of the associated one of the storage assemblies 11 whereby each of the support members 21 extends into the internal compartment 17 of the associated one of the storage assemblies 11. Each of the support members 21 engages the cover member 19 of the associated one of the storage assemblies 11 whereby the support members 21 are for inhibiting the cover member 19 from falling into the internal compartment 17 of the associated one of the storage assemblies 11 when the cover member 19 is positioned over the internal compartment 17 of the associated one of the storage assemblies 11.

Each of the storage assemblies 11 comprises a plurality of alignment members 22. Each of the alignment members 22 is coupled to a bottom wall of the perimeter wall 12 of the associated one of the storage assemblies 11. Each of the alignment members 22 comprises an alignment channel 23 extending into the associated one of the alignment members 22. The alignment channel 23 of each of the alignment members 22 receives one of the partition walls 15 of the associated one of the storage assemblies 11 for maintaining alignment of the partition walls 15.

The perimeter wall 12 of each of the storage assemblies 11 comprises a plurality of exterior walls 24 and a plurality of interior walls 25. The exterior walls 24 of each of the storage assemblies 11 is designed for being positioned around the perimeter of the mattress when the mattress is positioned on the storage assemblies 11. The interior walls 25 of each of the storage assemblies 11 abuts one of the interior walls 25 of an adjacent one of the storage assemblies 11 when the storage assemblies 11 are coupled together.

Each of the exterior walls 24 of each of the storage assemblies 11 comprises at least one access aperture 26 extending through the associated one of the storage assemblies 11. The access aperture 26 of each of the exterior walls 24 permits access to at least one of the external compartments 16 of the interior space 13 of the associated one of the storage assemblies 11 whereby the access aperture 26 is designed for permitting a user to place items into the associated one of the external compartments 16 of the associated one of the storage assemblies 11 when the mattress is positioned on the storage assemblies 11.

A plurality of storage aids 27 are operationally coupled to the storage assemblies 11. Each of the storage aids 27 is designed for facilitating storage of items by the user through the access aperture 26 of an associated one of the exterior walls 24.

At least one of the storage aids 27 comprises a drawer member 28. The drawer member 28 is selectively coupled to one of the storage assemblies 11 whereby the drawer member 28 is selectively extendable from the access aperture 26 of an associated one of the exterior walls 24. The drawer member 28 is designed for being accessed by the user when the mattress is positioned on the storage assemblies 11.

At least one of the storage aids 27 comprises a shelf member 29. The shelf member 29 is coupled to the perimeter wall 12 of one of the storage assemblies 11 whereby the shelf member 29 is positioned in the interior space 13 of the associated one of the storage assemblies 11. The shelf member 29 is designed for supporting items positioned in the interior space 13 of the associated one of storage assemblies 11.

At least one of the storage aids 27 comprises a door member 30. The door member 30 is hingably coupled to one of the exterior walls 24 of one of the storage assemblies 11 whereby the door member 30 is positioned proximate the access aperture 26 of the associated one of the exterior walls 24. The door member 30 is selectively positioned over the access aperture 26 of the associated one of the exterior walls 24 whereby the door member 30 is for selectively restricting access to the access aperture 26 of the associated one of the exterior walls 24.

Each of the interior walls 25 of each of the storage assemblies 11 comprises a plurality of mounting apertures 31 extending through the associated one of the interior walls 25. One of the mounting apertures 31 of one of the interior walls 25 of the associated one of the storage assemblies 11 is selectively aligned with one of the mounting apertures 31 of one of the interior walls 25 of an adjacent one of the storage assemblies 11 whereby the mounting apertures 31 are designed for receiving a mounting member to couple the storages assemblies together.

In use, the user places storage assemblies 11 in the desired configuration to receiving the mattress. The storage assemblies 11 are then coupled together by passing mounting members, such as bolts, through the mounting apertures 31 to secure the storage assemblies 11 together. The user can then remove the cover a member 19 from the from each of the storage assemblies 11 and place items in the internal compartment 17 of each of the storage assemblies 11 that are not accessed on a frequent basis, such as seasonal clothing. The cover member 19 of each of the storage assemblies 11 is replace on the associated one of the storage assemblies 11. The mattress is then placed on top of the storage assemblies 11 and items placed in the external compartments 16 of each of the storage assemblies 11. The casters 14 facilitate movement of all of the storage assemblies 11 and the mattress to a new location within the room.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed frame system for supporting a mattress and providing storage for a user, the bed frame system comprising:

a plurality of storage assemblies being adapted for being positioned under the mattress to support the mattress and the user when the user is positioned on the mattress, each of said storage assemblies comprising a perimeter wall defining an interior space or the associated one of said storage assemblies such that said interior space of each of said storage assemblies is adapted for receiving items to be stored under the mattress, said storage assemblies being selectively coupled together such that said storage assemblies are movable together to facilitate repositioning of the mattress, each of said storage assemblies comprising a plurality of casters being coupled to said perimeter wall, each of said casters being adapted for being positioned between said perimeter wall of the associated one of said storage assemblies and a support surface for facilitating moving of said storage assemblies across the support surface; and said perimeter wall of each of said storage assemblies comprising a plurality of exterior walls and a plurality of interior walls, said exterior walls of each of said storage assemblies being adapted for being positioned around the perimeter of the mattress when the mattress is positioned on said storage assemblies, said interior walls of each of said storage assemblies abutting one of said interior walls of an adjacent one of said storage assemblies when said storage assemblies are coupled together.

2. The bed frame system as set forth in claim 1, further comprising:

each of said storage assemblies comprising a plurality of partition walls, said partition walls being coupled to said perimeter wall such that said partition walls are positioned in said interior space of the associated one of said storage assemblies, each of said partition walls being adapted for providing additional support to the mattress when the mattress is positioned on said storage assemblies.

3. The bed frame system as set forth in claim 2, further comprising:

said partition walls of each of said storage assemblies dividing said interior space of the associated one of said storage assemblies into a plurality of external compartments and an internal compartment, said external compartments of said storage assemblies being adapted for being positioned under a perimeter of the mattress such that said external compartments are adapted for being accessed by the user to store items when the mattress is positioned on said storage assemblies, said internal compartment of each of said storage assemblies being adapted for being positioned proximate the center of the mattress when the mattress is positioned on said storage assemblies such that said internal compartment of said storage assemblies is accessible when the mattress is removed from said storage assemblies.

4. The bed frame system as set forth in claim 3, further comprising:

each of said storage assemblies comprising a fixed platform member, said fixed platform member being coupled to said perimeter wall and said partition walls of the associated one of said storage assemblies such that said fixed platform member is positioned over said external compartments of the associated one of said storage assemblies, said fixed platform of each of said storage assemblies being adapted for supporting the mattress and inhibiting the mattress from extending into said external compartments of the associated one of said storage assemblies when the mattress is positioned on said storage assemblies.

5. The bed frame system as set forth in claim 3, further comprising:

each or said storage assemblies comprising a cover member, said cover member being selectively positioned on said perimeter wall and said partitions walls of the associated one of said storage assemblies such that said over member is selectively positioned over said internal compartment of the associated one of said storage assemblies, said cover member is adapted for being removed by the user to permitting access to said internal compartment of the associated one of said storage assemblies when the mattress is removed from the storage assemblies.

6. The bed frame system as set forth in claim 5, further comprising:

said cover member of each of said storage assemblies comprising at least one finger aperture extending through said cover member, said finger aperture of said cover member being adapted for receiving a finger of the user to allow the user to engage the cover member to facilitate removal of said cover member from the associated one of said storage assemblies.

7. The bed frame system as set forth in claim 5, further comprising:

each of said storage assemblies comprising a plurality of support members, cash of said support members being coupled to said partition walls of the associated one of said storage assemblies such that each or said support members extends into said internal compartment of the associated one of said storage assemblies, each of said support members engaging said cover member of the associated one of said storage assemblies such that said support members are for inhibiting said cover member from falling into said internal compartment of the associated one of said storage assemblies when said cover member is positioned over said internal compartment of the associated one of said storage assemblies.

8. The bed frame system as set forth in claim 2, further comprising:

each of said storage assemblies comprising a plurality of alignment members, each of said alignment members being coupled to a bottom wall of said perimeter wall of the associated one of said storage assemblies, each of said alignment members comprising an alignment channel extending into the associated one of said alignment members, said alignment channel of each of said alignment member receiving one of said partition walls of the associated one of said storage assemblies for maintaining alignment of said partition walls.

9. The bed frame system as set forth in claim 1, further comprising:

each of said exterior walls or each of said storage assemblies comprising at least one access aperture extending through the associated one of said storage assemblies, said access aperture of each of said exterior walls permitting access to said interior space of the associated one of said storage assemblies such that said access aperture is adapted for permitting a user to place items into said interior space of the associated one of said storage assemblies when the mattress is positioned on said storage assemblies.

10. The bed frame system as set forth in claim 9, further comprising:

a plurality of storage aids being operationally coupled to said storage assemblies, each of said storage aids being adapted for facilitating storage of items by the user through said access aperture of an associated one of said exterior walls.

11. The bed frame system as set forth in claim 10, further comprising:

at least one of said storage aids comprising a drawer member, said drawer member being selectively coupled to one of said storage assemblies such that said drawer member is selectively extendable from said access aperture of an associated one of said exterior walls, said drawer member being adapted for being accessed by the user when the mattress is positioned on said storage assemblies.

12. The bed frame system as set forth in claim 10, further comprising:

at least one of said storage aids comprising a shelf member, said shelf member being coupled to said perimeter wall of one of said storage assemblies such that said shelf member is positioned in said interior space of the associated one of said storage assemblies, said shelf member being adapted for supporting items positioned in said interior space of the associated one of storage assemblies.

13. The bed frame system as set forth in claim 10, further comprising:

at least one of said storage aids comprising a door member, said door member being hingably coupled to one of said exterior walls of one of said storage assemblies such that said door member is positioned proximate said access aperture of the associated one of said exterior walls, said door member being selectively positioned over said access aperture of the associated one of said exterior walls such that said door member is for selectively restricting access to said access aperture of the associated one of said exterior walls.

14. The bed frame system as set forth in claim 1, further comprising:

each of said interior walls of each of said storage assemblies comprising a plurality of mounting apertures extending through the associated one of said interior walls, one of said mounting apertures of one of said interior walls of the associated one of said storage assemblies being selectively aligned with one of said mounting apertures of one of said interior walls, of an adjacent one of said storage assemblies such that said mounting apertures are adapted for receiving a mounting member to couple said storage assemblies together.

15. A bed frame system for supporting a mattress and providing storage for a user, the bed frame system comprising:

a plurality of storage assemblies being adapted for being positioned under the mattress to support the mattress and the user when the user is positioned on the mattress, each of said storage assemblies comprising a perimeter wall defining an interior space of the associated one of said storage assemblies such that said interior space of each of said storage assemblies is adapted for receiving items to be stored under the mattress, said storage assemblies being selectively coupled together such that said storage assemblies are movable together to facilitate repositioning of the mattress, each of said storage assemblies comprising a plurality of casters being coupled to said perimeter wall, each of said casters being adapted for being positioned between said perimeter wall of the associated one of said storage assemblies and a support surface for facilitating, moving of said storage assemblies across the support surface;

each of said storage assemblies comprising a plurality of partition walls, said partition walls being coupled to said perimeter wall such that said partition walls are positioned in said interior space of the associated one of said storage assemblies, each of said partition walls being adapted for providing additional support to the mattress when the mattress is positioned on said storage assemblies;

said partition walls of each of said storage assemblies dividing said interior space of the associated one of said storage assemblies into a plurality of external compartments and an internal compartment, said external compartments of said storage assemblies being adapted for being positioned under a perimeter of the mattress such that said external compartments are adapted for being accessed by the user to store items when the mattress is positioned on said storage assemblies, said internal compartment of each of said storage assemblies being adapted for being positioned proximate the center of the mattress when the mattress is positioned on said storage assemblies such that said internal compartment of said storage assemblies is accessible when the mattress is removed from said storage assemblies;

each of said storage assemblies comprising a fixed platform member, said fixed platform member being coupled to said perimeter wall and said partition walls of the associated one of said storage assemblies such that said fixed platform member is positioned over said external compartments of the associated one of said storage assemblies, said fixed platform of each of said storage assemblies being adapted for supporting the mattress and inhibiting the mattress from extending into said external compartments of the associated one of said storage assemblies when the mattress is positioned on said storage assemblies;

each of said storage assemblies comprising a cover member, said cover member being selectively positioned on said perimeter wall and said partitions walls of the associated one of said storage assemblies such that said cover member is selectively positioned over said internal compartment of the associated one of said storage assemblies, said cover member is adapted for being removed by the user to permitting access to said internal compartment of the associated one of said storage assemblies when the mattress is removed from the storage assemblies;

said cover member of each of said storage assemblies comprising at least one finger aperture extending through said cover member, said finger aperture of said cover member being adapted for receiving a finger of the user to allow the user to engage the cover member to facilitate removal of said cover member from the associated one of said storage assemblies;

each of said storage assemblies comprising a plurality of support members, each or said support members being coupled to said partition walls of the associated one of said storage assemblies such that each of said support members extends into said internal compartment of the associated one of said storage assemblies, each of said support members engaging said cover member of the associated one of said storage assemblies such that said support members are for inhibiting said cover member from falling into said internal compartment of the associated one of said storage assemblies when said cover member is positioned over said internal compartment of the associated one of said storage assemblies;

each of said storage assemblies comprising a plurality of alignment members, each of said alignment members being coupled to a bottom wall of said perimeter wall of the associated one of said storage assemblies, each of said alignment member; comprising an alignment channel extending into the associated one of said alignment members, said alignment channel of each of said alignment members receiving one of said partition walls of the associated one of said storage assemblies for maintaining alignment of said partition walls;

said perimeter wall of each of said storage assemblies comprising a plurality of exterior walls and a plurality of interior walls, said exterior walls of each or said storage assemblies being adapted for being positioned around the perimeter of the mattress when the mattress is positioned on said storage assemblies, said interior walls of each of said storage assemblies abutting one of said interior walls of an adjacent one of said storage assemblies when said storage assemblies are coupled together;

each of said exterior walls of each of said storage assemblies comprising at least one access aperture extending through the associated one of said storage assemblies, said access aperture of each of said exterior walls permitting access to at least one of said external compartments of said interior space of the associated one of said storage assemblies such that said access aperture is adapted for permitting a user to place items into the associated one of said external compartments of the associated one of said storage assemblies when the mattress is positioned on said storage assemblies;

a plurality of storage aids being operationally coupled to said storage assemblies, each of said storage aids being adapted for facilitating storage of items by the user through said access aperture of an associated one of said exterior walls;

at least one of said storage aids comprising a drawer member, said drawer member being selectively coupled to one of said storage assemblies such that said drawer member is selectively extendable from said access aperture of an associated one of said exterior walls, said drawer member being adapted for being accessed by the user when the mattress is positioned on said storage assemblies;

at least one of said storage aids comprising a shelf member, said shelf member being coupled to said perimeter wall of one of said storage assemblies such that said shelf member is positioned in said interior space of the associated one of said storage assemblies, said shelf member being adapted for supporting items positioned in said interior space of the associated the of storage assemblies;

at least one of said storage aids comprising a door member, said door member being hingably coupled to one of said exterior walls of one of said storage assemblies such that said door member is positioned proximate said access aperture of the associated one of said exterior walls, said door member being selectively positioned over said access aperture of the associated one of said exterior walls such that said door member is for selectively restricting access to said access aperture of the associated one or said exterior walls; and each of said interior walls of each of said storage assemblies comprising a plurality of mounting apertures extending through the associated one of said interior walls, one of said mounting apertures of one of said interior walls of the associated one of said storage assemblies being selectively aligned with one of said mounting apertures of one of said interior walls of an adjacent one of said storage assemblies such that said mounting apertures are adapted for receiving a mounting member to couple said storages assemblies together.

16. A bed frame system for supporting a mattress and providing storage for a user, the bed frame system comprising:

a plurality of storage assemblies being adapted for being positioned under the mattress to support the mattress and the user when the user is positioned on the mattress, each of said storage assemblies comprising a perimeter wall defining an interior space of the associated one of said storage assemblies such that said interior space or each of said storage assemblies is adapted for receiving items to be stored under the mattress, said storage assemblies being selectively coupled together such that said storage assemblies are movable together to facilitate repositioning of the mattress, each of said storage assemblies comprising a plurality of casters being coupled to said perimeter wall, each of said casters being adapted for being positioned between said perimeter wall of the associated one of said storage assemblies and a support surface for facilitating moving of said storage assemblies across the support surface;

each of said storage assemblies comprising a plurality of partition walls, said partition walls being coupled to said perimeter wall such that said partition walls are positioned in said interior space of the associated one of said storage assemblies, each of said partition walls being adapted for providing additional support to the mattress when the mattress is positioned on said storage assemblies; and said partition walls of each of said storage assemblies dividing said interior space of the associated one of said storage assemblies into a plurality of external compartments and an internal compartment, said external compartments of said storage assemblies being adapted for being positioned under a perimeter of the mattress such that said external compartments are adapted for being accessed by the user to store items when the mattress is positioned on said storage assemblies, said internal compartment of each of said storage assemblies being adapted for being positioned proximate the center of the mattress when the mattress is positioned on said storage assemblies such that said internal compartment of said storage assemblies is accessible when the mattress is removed from said storage assemblies.

17. The bed frame system an set forth in claim 16, further comprising:

each of said storage assemblies comprising a fixed platform member, said fixed platform member being coupled to said perimeter wall and said partition walls of the associated one of said storage assemblies, such that said fixed platform member is positioned over said external compartments of the associated one of said storage assemblies, said fixed platform of each of said storage assemblies being adapted for supporting the mattress and inhibiting the mattress from extending into said external compartments of the associated one of said storage assemblies when the mattress is positioned on said storage assemblies.

18. The bed frame system as set forth in claim 16, further comprising:

each of said storage assemblies comprising a cover member, said cover member being selectively positioned on said perimeter wall and said partitions walls of the associated one of said storage assemblies such that said cover member is selectively positioned over said internal compartment of the associated one of said storage assemblies, said cover member is adapted for being removed by the user to permitting access to said internal compartment of the associated one of said storage assemblies when the mattress is removed from the storage assemblies.

19. The bed frame system as set forth in claim 18, further comprising:

said cover member of each of said storage assemblies comprising at least one finger aperture extending through said cover member, said finger aperture of said cover member being adapted for receiving a finger of the user to allow the user to engage the cover member to facilitate removal of said cover member from the associated one of said storage assemblies.

20. The bed frame system as set forth in claim 18, further comprising:

each or said storage assemblies comprising a plurality of support members, each of said support members being coupled to said partition walls of the associated one of said storage assemblies such that each of said support members extends into said internal compartment of the associated one of said storage assemblies, each of said support members engaging said cover member of the associated one of said storage assemblies such that said support members are for inhibiting said cover member from falling into said internal compartment of the associated one of said storage assemblies when said cover member is positioned over said internal compartment of the associated one of said storage assemblies.

* * * * *